US009376236B2

(12) United States Patent
Langh-Lagerlof

(10) Patent No.: US 9,376,236 B2
(45) Date of Patent: Jun. 28, 2016

(54) CONTAINER INCLUDING OBJECT-SUPPORTING CHUTE AND PIVOT MECHANISM

(75) Inventor: Laura Langh-Lagerlof, Piikkio (FI)

(73) Assignee: OY LANGH SHIP AB, Piikkio (FI)

( * ) Notice: Subject to any disclaimer, the term of this patent is extended or adjusted under 35 U.S.C. 154(b) by 62 days.

(21) Appl. No.: 14/009,540

(22) PCT Filed: Apr. 4, 2012

(86) PCT No.: PCT/EP2012/056169

§ 371 (c)(1),
(2), (4) Date: Oct. 3, 2013

(87) PCT Pub. No.: WO2012/136706

PCT Pub. Date: Oct. 11, 2012

(65) Prior Publication Data

US 2014/0027321 A1 Jan. 30, 2014

(30) Foreign Application Priority Data

Apr. 7, 2011 (FI) ..... 20115334

(51) Int. Cl.
*B65D 25/10* (2006.01)
*B65D 90/00* (2006.01)
*B65D 85/02* (2006.01)

(52) U.S. Cl.
CPC ..... *B65D 25/103* (2013.01); *B65D 85/02* (2013.01); *B65D 90/006* (2013.01); *B65D 2590/0058* (2013.01)

(58) Field of Classification Search
CPC ..... B65D 25/00; B65D 25/10; B65D 25/103; B65D 85/00; B65D 85/02; B65D 85/04; B65D 85/06; B65D 90/004; B65D 90/006
USPC ..... 206/389
See application file for complete search history.

(56) References Cited

U.S. PATENT DOCUMENTS 2,991,734 A 9/1959 Gabriel
3,750,826 A * 8/1973 Donath et al. ..... 220/324

(Continued)

FOREIGN PATENT DOCUMENTS

CN 1712328 * 12/2005 ..... B65D 88/12
CN 1712328 A 12/2005

(Continued)

OTHER PUBLICATIONS

International Search Report dated Jul. 24, 2012; corresponding to PCT/EP2012/056169.

(Continued)

*Primary Examiner* — Steven A. Reynolds
*Assistant Examiner* — Javier A Pagan
(74) *Attorney, Agent, or Firm* — Young & Thompson

(57) ABSTRACT

A container includes a chute for supporting reels, the chute including a bottom, a lower wall zone, an upper wall zone, and a support frame for supporting the chute. The container has a horizontal support plane on both sides of the chute, the upper wall zone being formed by a first support surface of a wedge-like support member placed onto the support plane, a second support surface of the support member resting against the support plane when the support member is in a first use position; a pivot mechanism allowing the support member to be turned in relation to the support frame so that the first support surface sets against the lower wall zone of the chute and the second support surface sets onto the same height level as the support plane for forming a uniform loading plane and for placing the support member to a second use position.

20 Claims, 4 Drawing Sheets

(56) References Cited

U.S. PATENT DOCUMENTS

| | | | | |
|---|---|---|---|---|
| RE37,575 | E | 3/2002 | Lambert | |
| 6,579,048 | B2 * | 6/2003 | Al-Kaabi et al. | 410/49 |
| 7,972,098 | B2 * | 7/2011 | DeMent | 410/49 |

FOREIGN PATENT DOCUMENTS

| | | | |
|---|---|---|---|
| CN | 200974691 | Y | 11/2007 |
| CN | 201040633 | Y | 3/2008 |
| CN | 201309705 | Y | 9/2009 |
| CN | 101723153 | A | 6/2010 |
| DE | 3245951 | | 6/1984 |
| EP | 0 460 715 | | 12/1991 |
| EP | 1 967 466 | | 9/2008 |
| FI | 121372 | | 10/2010 |
| WO | 0187742 | A1 | 11/2001 |
| WO | 2007/008815 | | 1/2007 |
| WO | 2009/118459 | | 10/2009 |

OTHER PUBLICATIONS

Finnish Search Report dated Mar. 7, 2012, corresponding to the Foreign Priority Application No. 20115334.

Chinese Office Action, dated Nov. 5, 2014, from corresponding CN application.

* cited by examiner

CONTAINER INCLUDING OBJECT-SUPPORTING CHUTE AND PIVOT MECHANISM

BACKGROUND OF THE INVENTION

The invention relates to a container comprising a chute for supporting cylindrical objects, such as reels and tubes, the chute comprising a bottom and a wall structure that extends upward and outward from the bottom of the chute on both sides thereof and is bipartite on both sides of the chute, comprising a lower wall zone and an upper wall zone as an extension of the lower wall zone, and a support frame for supporting the chute.

This type of container is known from publication WO 2009/118459 A1. A problem with this prior art container is that it is not suitable for carrying other than cylindrical cargo items. When used for carrying a cylindrical item from point A to point B, the cylindrical item being unloaded in point B, the container is not useful for the continued transport unless other cylindrical objects are to be carried from point B. As a result, the container returning from point B is typically empty until reloaded again in point A (or some other point) with cylindrical cargo items.

BRIEF DESCRIPTION OF THE INVENTION

An object of the invention is to provide a new container which is easily modifiable to be adapted to carry cylindrical cargo items or, alternatively, in principle any other cargo. The container allows a cylindrical cargo item to be carried to its destination and in principle any cargo on the way back —or vice versa. The container even enables both cylindrical cargo items and other cargo to be carried at the same time.

The container of the invention is characterized by what is disclosed in the accompanying claim 1.

There is preferably a first pivot at a tip of a wedge-shaped support member and a second pivot close to the top edge of the lower wall zone, below the surface of the lower wall zone. This type of arrangement enables the support member to be dimensioned in such a manner that a distance between the lower wall zone and the upper wall zone, i.e. a transition area, can be made small and the chute as uniform as possible without a wide interfering transition or discontinuation when the support member is in a first position of use and serves as the upper wall zone of the chute.

Both sides at the respective ends of the support member are preferably provided with a pivot mechanism because this type of pivoting increases the solidity of the structure.

The support member preferably comprises a third support surface arranged to rest on the bottom of the chute when the support member is in the second position of use. The resting of the support member against the chute bottom is highly recommended because the bottom of the chute is easy to make structurally strong.

The container preferably comprises a multitude of support members at a distance from one another, with pivot mechanisms at both ends of the pieces, the ends of the support members being also preferably formed as stopping means for preventing cylindrical objects from sliding in a longitudinal direction of the chute. Because of the multitude of support members, the container offers a wide variety of modification options, and the weight of the support members remains relatively low which makes the support members easy to turn manually. It is recommended to prevent reels and rolls from sliding in the chute, because sliding causes high impact loads on the structures. When a support member is turned down, its side serves as a means of stopping a reel or a roll. A risk of reels sliding and moving arises when the container is subject to high acceleration forces during transport.

The preferred embodiments of a container according to the invention are disclosed in the dependent claims.

Major advantages of the container of the invention are its suitability for various uses and extreme ease of modification according to need: it is suitable for carrying not only round cargo items but also other types of load. Moreover, when heavy reels are transported, the mass centre is low. The pivot mechanism with two pivots and a pivoting arm connecting them enables a uniform chute to be formed in which the pivot mechanism does not protrude from the chute. Such a protrusion would be in the way during loading or transport and thus prone to damage. In addition, the pivot mechanism allows the chute to be provided with a friction-increasing material with the aim of improving friction against cylindrical objects to be carried and avoiding damage to the cargo, without the friction-increasing material causing high loads to the pivot mechanism when the container is used for transporting other than cylindrical objects and when the support members are turned into a position in which they and the horizontal support plane together form a uniform loading plane.

BRIEF DESCRIPTION OF FIGURES

The invention will now be described in greater detail by means of two embodiments and with reference to the attached drawing, in which.

DETAILED DESCRIPTION OF THE INVENTION

Figure 1:
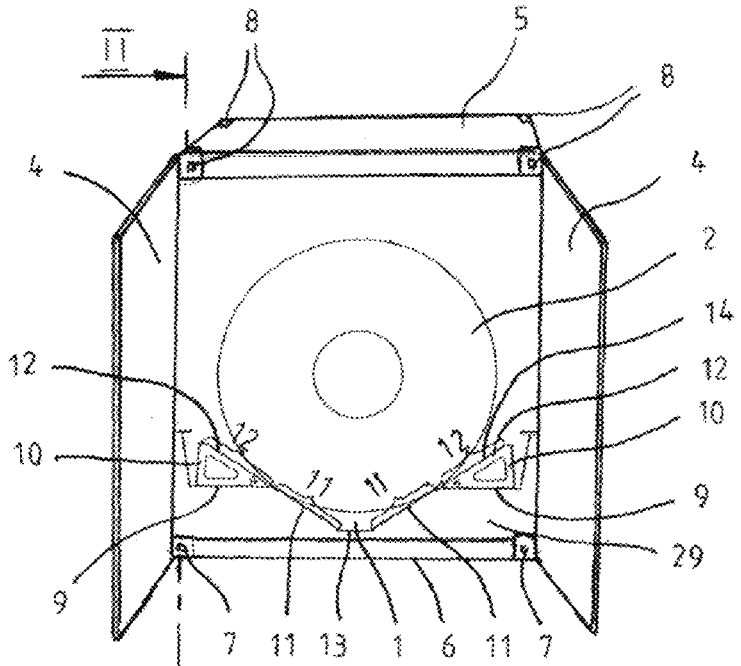
FIG. 1 illustrates a container from one end.
Figure 2:
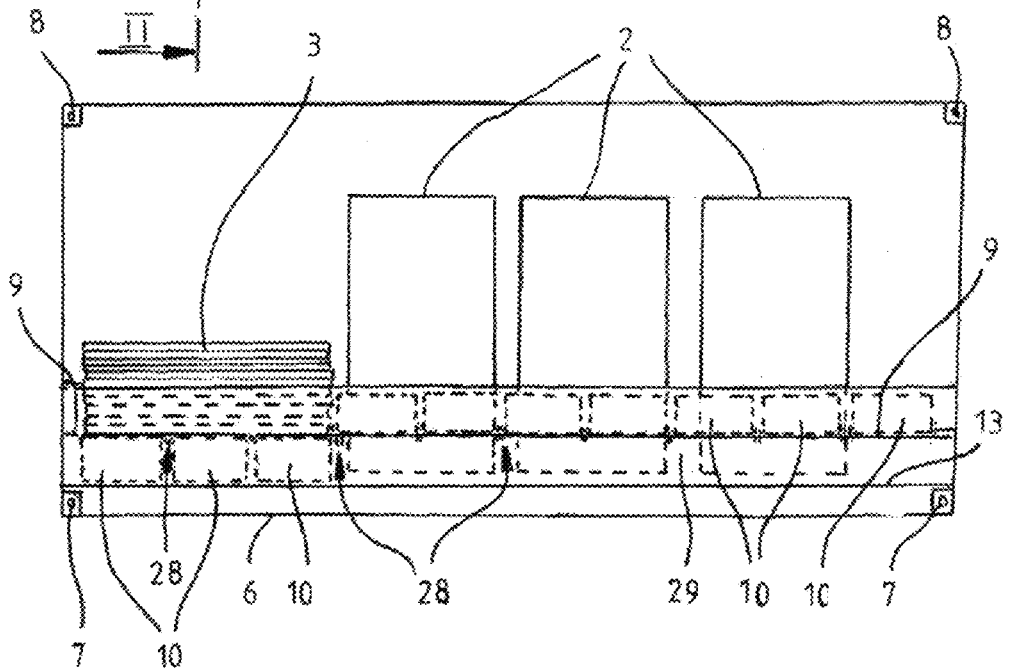
FIG. 2 illustrates the container of FIG. 1 along a section line II-II of FIG. 1.

FIG. 1 is a perspective end view illustrating a container of the invention and FIG. 2 is a side view illustrating the container of FIG. 1 along a section line II-II of FIG. 1. The dimensions of the container correspond to those of a standard container of 20 feet. Hence the width of the container is 8 feet and the height of the container is approximately 8.5 feet.

The container comprises a chute 1 in a longitudinal direction thereof, with three reels 2 loaded in the chute. The reels are steel reels, but they could be paper reels or other cylindrical objects, such as tubes. At one end of the container there is a plate load 3 (see FIG. 2). An operating mechanism included in the container allows a desired length to be chosen for the chute 1. In FIG. 2 the length of the chute 1 has been set equal to about three reels, the chute being filled close to one end thereof with wedge-like support members 10 belonging to the operating mechanism. The structure and operation of the support pieces is described below. A support member 10 may be considered to comprise three main surfaces and two ends which form respective sides of the support member.

The container may be loaded through stowage doors 4 provided either at an end or ends thereof or through a roof structure 5 of the container. The roof structure 5 of the container can thus be opened. The roof structure forms a top plane of the container.

All corners of the container bottom 6 are provided with fastening means 7 for fastening the container to a transport vehicle, such as a train, ship or truck (not shown). Means conventionally used in containers for fastening them to a platform or bottom of a vehicle are recommended for use as fastening means 7. The corners of the roof structure 5 are provided with corresponding fastening devices 8. Likewise, prior art container fastening devices allowing containers to be loaded one on top of the other are recommended for use a fastening devices 8.

In FIG. 2 a plate load 3 has been piled on top of the loading plane of the container.

FIG. 1 shows that the chute 1 is formed of a bottom 13 and of a lower wall zone 11 and an upper wall zone 12 extending upward from the bottom and on both sides thereof. The upper wall zones 12 form an extension of the lower wall zone 11. The upper wall zones 12 are formed of support surfaces 14 of the wedge-shaped support members 10. The lower surfaces 15 of the support members 10 are supported by the horizontal support plane 9 on both sides of the chute 1. A reel 2 rests against an upper area of the lower wall zone 11. However, the upper wall zones 12 are needed to prevent a reel from drifting during transport to the support plane 9 of the container, which could easily cause the reel to penetrate a side wall of the container or make the container and the vehicle, such as a railway carriage, underneath it to fall on its side. Although not shown in the Figures, it is conceivable that the reel 2 rests against the upper wall zone 12. The latter may be the case when large reels are transported.

FIG. 2 shows that each reel 2 is supported by two support members 10 on one side, each reel being thus supported by a total of four support members. The support members 10 are depicted by a broken line. The support members 10 under the plate load 3, altogether 3+3=6 of them, have been turned to a position in which they allow a plate load 3 (or some other load) to be placed onto the loading plane. Turning of the support members is enabled by a pivot mechanism, which in FIG. 2 is generally indicated by reference numeral 28.

Figure 4:
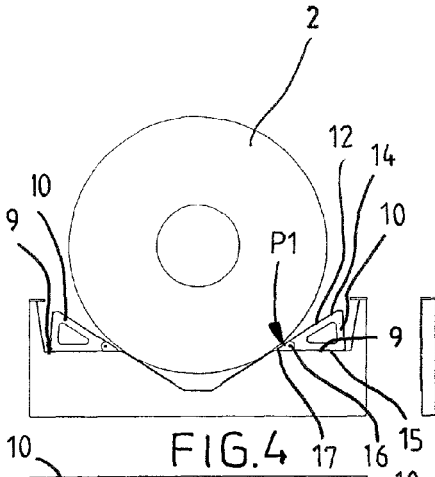
FIGS. 3 to 6 show a central operating mechanism of the container in a first position of use.
Figure 5:
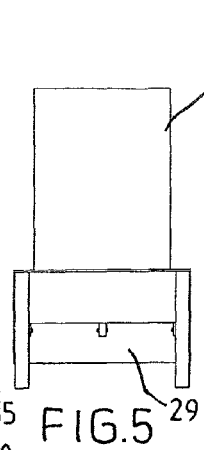
Figure 3:
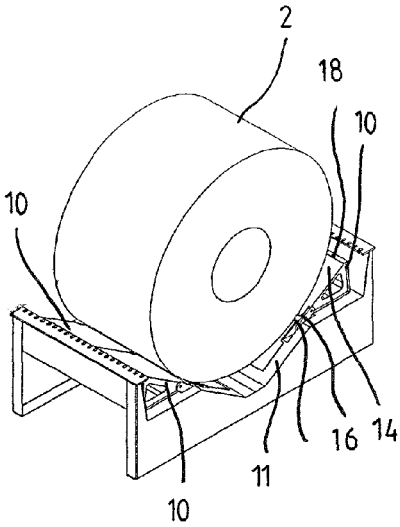
Figure 6:
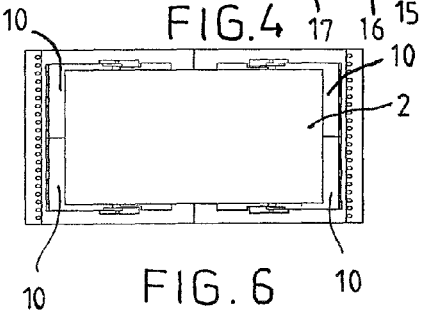

FIGS. 3 to 6 show how the reel 2 is supported in the chute. For the sake of simplicity, FIGS. 3 to 6 only show part of the length of the container chute 1. FIG. 4 is a front view, FIG. 5 a side view and FIG. 6 a top view of an operating mechanism and the reel 2 according to FIG. 3. In FIGS. 3 to 6 the support members 10 are in a first position of use, the support surface 14 of the support members forming the upper wall zone 12 of the chute. FIGS. 3 and 4 show that a lower edge 16 of the support surface 14 of the support member 10 sets close to a top edge 17 of the lower wall zone 11 of the chute and that the height position of the support plane 9 sets at the top edge 17 and the lower edge 16. Because there is no wide and deep discontinuation between the lower edge 16 and the top edge 17, support from the chute 1 to the reel 2 is uniform even if the reel momentarily, for example during marine transport, were to shift upwards in the chute 1. In FIGS. 3 to 6 the support plane 9 does not serve as an actual loading plane but as a support plane against which the support surfaces 15 of the support members 10 rest.

FIGS. 7 to 10 how the support members 10 fill the chute and covered it. In FIGS. 7 to 10 the support members 10 have been turned down, their first support surface 14 resting against the lower wall zone 11 of the chute and the relatively short support surface 18 of the support members 10 resting against the chute bottom 13. It is possible to have a support member rest against the chute only on its support surface 18 or support surface 14, but it is recommended to provide the support member with a large support surface formed by the lower wall zone of the chute and the chute bottom 13.

The support members 10 are easy to install into the position shown in FIGS. 7 to 10 because of a pivot mechanism 28 joining the support members 10 to the support frame 29 of the chute. The pivot mechanism of the support members 10 will be described in greater detail below with reference to FIG. 19. The structure of the support frame 29 is not shown in detail in the figures because it does not require special effort from a skilled professional to achieve. Naturally, the support frame 29 must be sufficiently strong to be able to support the chute and the cargo placed therein. The support frame 29 is preferably made so strong that it allows a container full of heavy reels or other cargo to be lifted by a crane.

Figure 8:
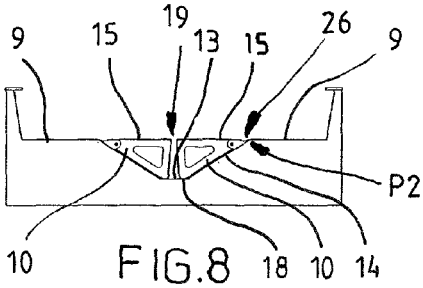
FIGS. 7 to 10 show a central operating mechanism of the container in a second position of use.
Figure 9:
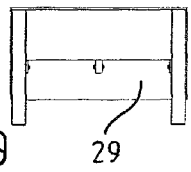
Figure 10:
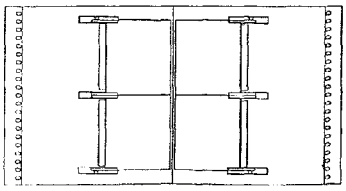
Figure 7:
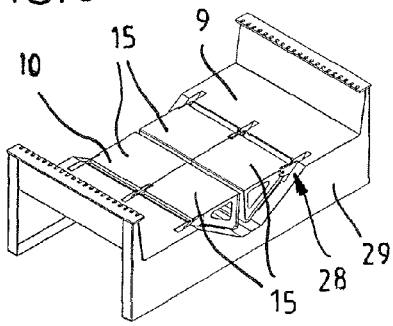

When the support members 10 are turned to the position shown in FIGS. 7 and 8 their support surface 15 sets to the same height level as the support plane 9. The support members 10 and the support plane 9 thus form a uniform loading plane onto which cargo of various kinds may be loaded, i.e. cargo which is usually transported in containers. As shown in FIGS. 7 and 10, there is hardly any gap between adjacent support members but the support surfaces 15 continue in the longitudinal direction of the chute, forming a continuous support surface.

FIGS. 11 to 16 illustrate how a support member 10 belonging to the operating mechanism is turned from the first position of use shown in FIGS. 3 to 6 to the second position of use shown in FIGS. 7 to 10.

Figure 12:
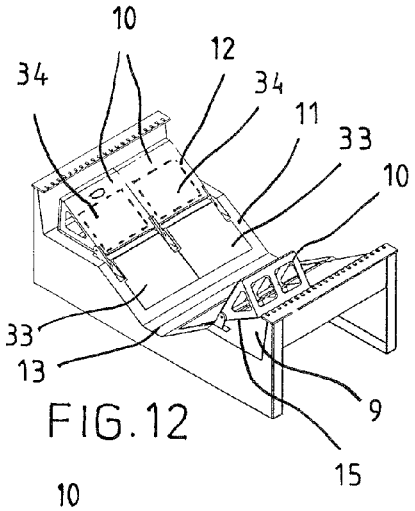
FIGS. 11 to 18 show the setting of the central operating mechanism of the container in different positions of use (cf. the positions of use in FIGS. 3 to 6 and 7 to 9)
Figure 11:
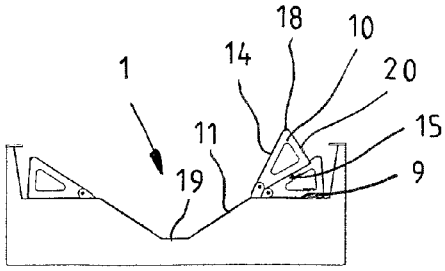
Figure 14:
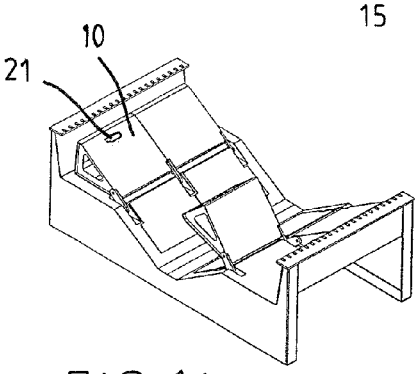
Figure 13:
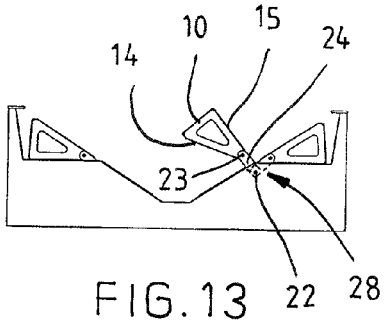
Figure 18:
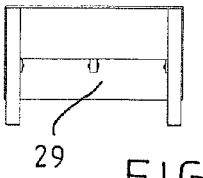
Figure 15:
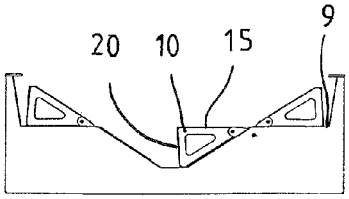
Figure 16:
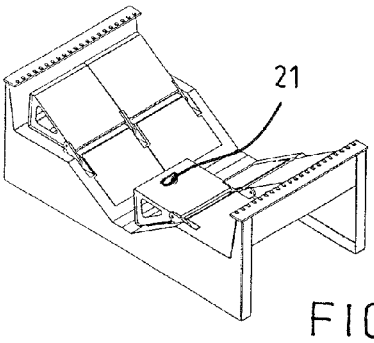
Figure 17:
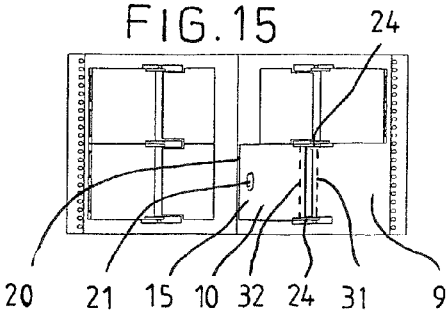

In FIGS. 11 and 12 one support member 10 has been lifted upwards so that its support surface 15 is at an angle of about 35 degrees to the support plane 9. In FIGS. 13 and 14 the angle is about 120 degrees and in FIGS. 15 to 17 it is 180 degrees, the support surface 15 being at the same level as the support plane 9. When all the support members of FIGS. 15 to 17 in the upper position are turned down, the situation shown in FIGS. 7 to 10 is arrived at.

The support members 10 are turned by hand. To facilitate the turning, all—or possibly only some—of the support surfaces 15 and 14 of the support members 10 may be provided with openings 21, see FIGS. 14 and 16 and 17, openings (not shown) being possibly also provided in support member surfaces 20 (see surface 20 in FIG. 15). The openings 21 allow to take hold for lifting the support members 10.

Figure 19:
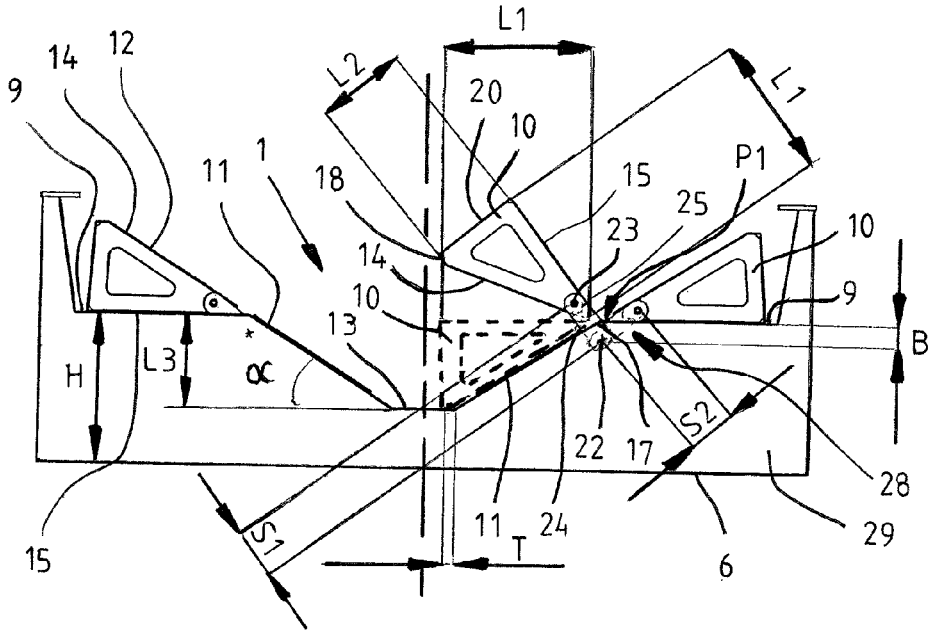
FIG. 19 is an enlargement of FIG. 13 and aims at illustrating in greater detail the central operating mechanism of the container and its structure.

In FIG. 19 the operating mechanism associated with the chute 1 is shown in greater detail than above. Both sides of the ends of the support members 10 are articulated to the support frame by a pivot mechanism 28 comprising two pivots 22, 23. The pivots 22, 23 are at a distance S1 from one another and connected by a pivot arm 24. The distance S1 between the pivots 22, 23 exceeds the distance of the second pivot 22 from the top edge 17 of the lower wall zone 11. The distance S1 is preferably 10 to 20 mm. The pivot 22 is linked to the support frame 29 of the chute, the pivot 23 being located at the tip 25 of the support member 10 (the support member tip closer to the top edge 17 of the lower wall zone 11) or very close to it. The pivot 22 is below the support plane 9, at a distance B from the support plane. The pivot 22 is preferably a bar (see reference numeral 31 in FIG. 17) extending in a longitudinal direction of the container, the pivot arm 24 being provided with an opening to serve as a bearing of the bar 31 (see FIG. 17). The distance B is preferably 5 to 10 mm. The pivot 23 is preferably a bar (see reference numeral 32 in FIG. 17) extending from one end of the support member 10 to the other end thereof. The bar 32 (see FIG. 17) has been welded to the pivot arms 24 at the ends of the support member, the tip 25 of the support member being provided with openings at the ends thereof to serve as a bearing of the bar 32. This type of bar 32 welded to the pivot arms 24 and connecting them stabilizes the pivot mechanism 28 and greatly facilitates the turning of the support member 10 to a desired position of use. The support surface 15 of the support members has a length L1 which is 40 to 50 cm, preferably about 45 cm. The chute has an angle α, which is 30 to 40 degrees, preferably about 35 degrees. In broader terms the angle may be 25 to 45 degrees. Outside this range it is likely that the chute does not support the reels well. The support surface 9 has a height H, i.e. a distance from the bottom 6, which is about 40 to 50 cm, preferably about 45 cm. In broader terms the distance H from the bottom 6 may be 25 to 50 cm. Height L2 of the surface 20 of the support member 10 corresponds to height L3 of the lower wall zone of the chute and is 15 to 30 cm. Seen from an end, the support member 10 has the shape of a right-angle triangle in which the smallest angle corresponds to the inclination of the chute (i.e. about 35 degrees). The dimensions and values given are based on a container width of 8 feet, i.e. about 2.4 m.

The disclosed dimensioning and arrangement of the different parts of the operating mechanism allows the lower edge 16 of the support surface 14 of the support member 10, which is close to the tip 25 of the support member and forms part of the chute, to set close to the top edge 17 of the lower wall zone 11, when the support member is in its first position of use, leaving no harmful discontinuation at point P1 between the top edge 17 and the lower edge 16.

The disclosed arrangement also allows the tip 25 of the support member 10 to be turned over the top edge 17 of the lower wall zone 11 and past it without the tip 25 touching the top edge 17 of the wall zone 11 at point P1, which would prevent the tip 25 from turning past the top edge.

Because of the disclosed arrangement no harmful gap is left between the support surfaces 15 of two opposite support members 10 turned down; see arrow 19 in FIG. 8, which depicts an extremely small gap that is not harmful. It may be said that in practice the opposite support surfaces 15 form a uniform loading surface or a loading surface area.

Because of the disclosed arrangement, no harmful discontinuation is left in point P2 between a support member 10 turned down and the top edge 17 of the lower wall zone 11; see arrow 26 in FIG. 8.

Because of the disclosed pivot mechanism and arrangement no component of the pivot mechanism (pivot 22, 23 or the pivot arm 24 connecting the pivots) reaches above the surface of the loading plane when the support member 10 is in its second position of use, in which it forms part of the loading plane (cf. FIG. 8). Further, because of the disclosed pivot mechanism and arrangement no component of the pivot mechanism (pivot 22, 23 or the pivot arm 24 connecting the pivots) reaches above the support surfaces formed by the inclined wall zones 11, 12 of the chute when the support member 10 is in its first position of use, in which it forms part of the chute (cf. FIG. 4).

The chute 1 and the support members 10 of the container are made of steel. A reel 2 made of steel has a low friction against steel. Because of the above, it is recommended to arrange an elastomer layer (e.g. a rubber layer or a rubber coating) on top of the lower or higher wall zone 11 or 12 of the chute—or on top of both the lower and the higher wall zone. For the sake of simplicity the elastomer layers are shown in slightly greater detail only in FIG. 12, in which reference numeral 33 indicates an elastomer layer laid on top of the lower wall zone 11 and reference numeral 34 an elastomer layer laid on top of the upper wall zone 12, i.e. the support surface 14 of the support member 10. The elastomer layers 33, 34 increase the friction of the chute 1 against the cargo being carried, which reduces the tendency of the cargo to slide in a longitudinal direction of the chute during transport. A further advantage of the elastomer layers is that they attenuate shocks possibly caused by the load placed onto the chute 1. The pivots 22 and 23 and the pivot arms 24 interconnecting them allow the elastomer layers 33, 34 laid on top of the support surfaces 14 of the support members 10 and the wall zones 11 to be placed parallel against each other in the position shown in FIG. 8 (in which the support members 10 have been turned against the wall zones) without the pivots 22, 23 being subjected to high torsional loads during loading of cargo onto the support surfaces 15.

Figure 20:
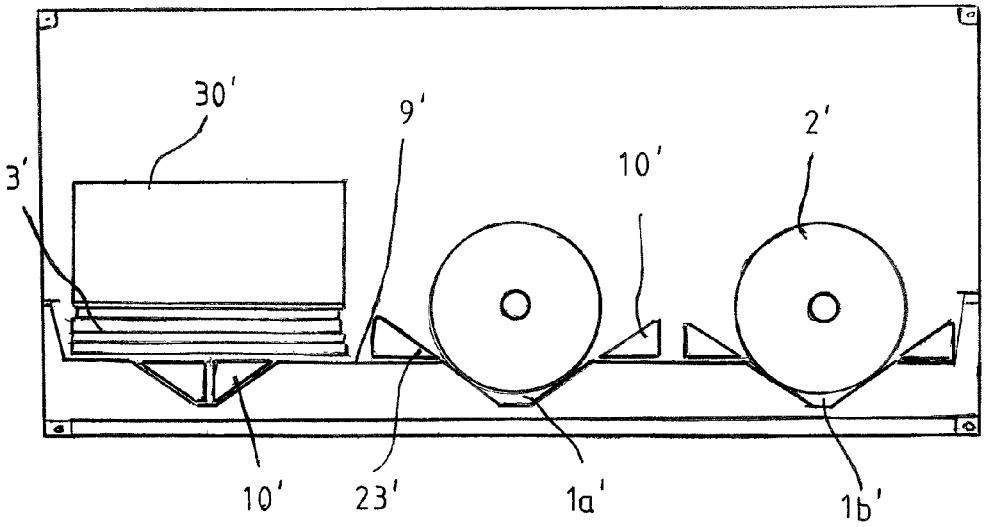
FIG. 20 illustrates a second embodiment of the invention comprising an operating mechanism similar to the solution in FIGS. 1 to 19.

FIG. 20 illustrates a second embodiment of the invention. A container comprises three chutes in a transverse position to a longitudinal direction of the container. Similarly as in FIG. 2 the container is a container of standard dimensions and comprises fastening arrangements at its corners to allow the container to be fastened to a platform and to receive another container on top of it. The container of FIG. 20 has four reels 2': two reels one after the other in a chute 1*a*' and two reels one after the other in a chute 1*b*'. At the left-hand end of the container there is a plate load 3' loaded on the loading plane and another load 30' on top of the plate load. The support members 10' of the container in FIG. 20 are functionally and structurally similar to the support members 10 in FIG. 2. The container in FIG. 20 comprises stowage doors (not shown) provided in a longitudinal wall of the container.

The invention is described above by means of two examples only. It is to be noted that the details of the invention may be implemented in various ways within the scope of the attached claims. Hence the number of the support members 10, 10', for example, may vary. The disclosed dimensions of the operating mechanism associated with the chute of the container may vary to some extent although not much because otherwise all the disclosed advantages are not obtained. The disclosed dimensioning specifically allows the above-identified advantages to be obtained, which is why the disclosed dimensioning is significant. The container does not need to be a standard container of 20 feet, as disclosed, but may be a standard container of 40 or 45 feet, for example. The container does not need to be 8 feet wide but its width may correspond to that of a container known as a pallet-wide container, which is slightly more than 8 feet and is about 2.5 to 2.6 m. The container does not need to be 8.5 feet high but a container known as a high cube container having a height of 9.5 feet or about 2.9 m is possible. All of these standard containers allow the advantages of the invention to be achieved. As to the possibilities of modification, it should be mentioned that the roof of the container does not need to be detachable, although in view of the loading of the container this is highly recommended. The container is naturally suitable for transporting not only reels but other types of cylindrical loads as well, such as paper rolls, tubes or round bars.

The invention claimed is:

1. A container, comprising:

a chute configured to support cylindrical objects the chute comprising a bottom, and a wall structure that extends upward and outward from the bottom of the chute on both sides thereof and is bipartite on both sides of the chute, the wall structure comprising a lower inclined wall zone, an upper wall zone as an extension of the lower wall zone, and a support frame configured to support the chute; and a horizontal support plane on both sides of the chute, the horizontal support plane having a height position in the container set at a top edge of the lower inclined wall zone and at a lower edge of the upper wall zone, each upper wall zone being formed of a first support surface of a wedge-like support member placed onto the support plane, and a second support surface of the support member resting against the support plane when the support member is in a first position of use, the support member being turnable by a pivot mechanism in relation to the support frame of the chute so that the first support surface of the support member sets against the lower inclined wall zone of the chute and the second support surface of the support member sets at the same height level as the support plane to form a uniform loading plane and to place the support member at a second position of use, the pivot mechanism comprising a first pivot in the support member, a second pivot under the support plane and under the top edge of the lower inclined wall zone at a distance from the support plane, and a pivot arm connecting the first pivot to the second pivot, the first pivot and the second pivot being disposed at a distance from one another, the distance exceeding a distance of the second pivot from the top edge of the lower inclined wall zone.

2. The container as claimed in claim 1, wherein the first pivot is at a tip of the support member and the second pivot is close to the top edge of the lower inclined wall zone, below the support surface formed by the lower inclined wall zone.

3. The container as claimed in claim 2, wherein the pivot mechanism is disposed at both ends of the support member.

4. The container as claimed in claim 2, wherein the support member comprises a third support surface configured to be supported by the bottom of the container when the support member is in the second position of use.

5. The container as claimed in claim 2, wherein the container comprises a plurality of support members at a distance from one another, with a pivot mechanism at both ends thereof.

6. The container as claimed in claim 2, wherein the loading platform extends substantially over the entire bottom surface of the container when the support members have been turned to the second position of use.

7. The container as claimed in claim 1, wherein the pivot mechanism is disposed at both ends of the support member.

8. The container as claimed in claim 1, wherein the support member comprises a third support surface configured to be supported by the bottom of the container when the support member is in the second position of use.

9. The container as claimed in claim 1, wherein the wall structure of the chute is at an angle of 30 to 40 degrees with regard to the horizontal.

10. The container as claimed in claim 1, wherein the chute is disposed in a longitudinal direction of the container and extends from one container end to the other container end, and the container comprises a stowage door at an end of the container.

11. The container as claimed in claim 1, wherein the container comprises a plurality of support members at a distance from one another, with a pivot mechanism at both ends thereof.

12. The container as claimed in claim 11, wherein the ends of the support members are stopping devices configured to prevent cylindrical objects from sliding in a longitudinal direction of the chute.

13. The container as claimed in claim 11, wherein the loading platform extends substantially over the entire bottom surface of the container when the support members have been turned down to the second position of use.

14. The container as claimed in claim 1, wherein the loading platform extends substantially over the entire bottom surface of the container when the support members have been turned to the second position of use.

15. The container as claimed in claim 14, wherein the ends of the support members are stopping devices configured to prevent cylindrical objects from sliding in a longitudinal direction of the chute.

16. The container as claimed in claim 1, wherein the dimension of the container corresponds to the dimension of a standard container, a bottom of the container comprises fastening means at the corners thereof for fastening the container to a transport vehicle, and a top plane comprises fastening devices at the corners thereof configured to receive another container, the fastening devices being dimensioned to allow the container to be lifted by a crane.

17. The container as claimed in claim 1, wherein a top plane of the container is a detachable roof structure.

18. The container as claimed in claim 1, further comprising a plurality of chutes in a transverse position to the longitudinal direction of the container.

19. The container as claimed in claim 1, wherein the lower inclined wall zone or the first support surface of the support member comprises an elastomer layer.

20. The container according to claim 1, wherein the chute is configured to support one or more of reels and tubes.

* * * * *